US010604363B2

(12) United States Patent
Takagi et al.

(10) Patent No.: US 10,604,363 B2
(45) Date of Patent: Mar. 31, 2020

(54) SHEET FEEDING APPARATUS

(71) Applicant: Funai Electric Co., Ltd., Osaka (JP)

(72) Inventors: Masaaki Takagi, Kashihara (JP); Masanori Yamada, Nara (JP); Daisuke Ogawa, Daito (JP)

(73) Assignee: Funai Electric Co., LTD., Osaka (JP)

( * ) Notice: Subject to any disclaimer, the term of this patent is extended or adjusted under 35 U.S.C. 154(b) by 0 days.

(21) Appl. No.: 15/810,843

(22) Filed: Nov. 13, 2017

(65) Prior Publication Data

US 2018/0170694 A1 Jun. 21, 2018

(30) Foreign Application Priority Data

Dec. 16, 2016 (JP) ..... 2016-244792

(51) Int. Cl.

| | |
|---|---|
| ***B65H 1/28*** | (2006.01) |
| ***B65H 1/02*** | (2006.01) |
| ***B41J 13/00*** | (2006.01) |
| ***B65H 3/06*** | (2006.01) |

(52) U.S. Cl.

CPC ..... *B65H 1/28* (2013.01); *B41J 13/0018* (2013.01); *B65H 1/02* (2013.01); *B65H 3/06* (2013.01); *B65H 2402/46* (2013.01); *B65H 2405/115* (2013.01); *B65H 2405/324* (2013.01); *B65H 2405/3312* (2013.01); *B65H 2801/12* (2013.01)

(58) Field of Classification Search

USPC ..... 406/49

See application file for complete search history.

(56) References Cited

U.S. PATENT DOCUMENTS

| | | | | |
|---|---|---|---|---|
| 4,429,863 | A * | 2/1984 | Itoh | G03B 27/585 271/127 |
| 4,872,660 | A * | 10/1989 | Kameyama | B65H 5/26 271/117 |
| 5,927,702 | A * | 7/1999 | Ishii | B65H 5/36 271/171 |
| 6,029,970 | A * | 2/2000 | Hwang | B41J 11/48 271/124 |
| 6,364,553 | B1 | 4/2002 | McCue, Jr. et al. | |
| 6,942,211 | B2 * | 9/2005 | Teo | B41J 11/0025 271/145 |

(Continued)

FOREIGN PATENT DOCUMENTS

| | | | |
|---|---|---|---|
| EP | 2 899 031 | A1 | 7/2015 |
| EP | 2 947 863 | A1 | 11/2015 |
| JP | 2005-41213 | A | 2/2005 |

OTHER PUBLICATIONS

Extended European Search Report in counterpart European Application No. 17 20 0627.2 dated May 23, 2018 (7 pages).

*Primary Examiner* — Thomas A Morrison
(74) *Attorney, Agent, or Firm* — Osha Liang LLP

(57) ABSTRACT

A sheet feeding apparatus includes a casing that comprises a sheet feeding port, a first sheet feed tray in which a first medium is loaded and that is arranged along a sheet feeding port, and a cover that rotates from a position opposite the first sheet feed tray of the casing to a first sheet feed tray side and covers the sheet feeding port. The cover includes a second sheet feed tray that causes a second medium differing in size from the first medium to be capable of being loaded in the sheet feeding port when the cover covers the sheet feeding port.

17 Claims, 14 Drawing Sheets

(56) References Cited

U.S. PATENT DOCUMENTS

| | | | | |
|---|---|---|---|---|
| 7,290,762 | B2 * | 11/2007 | Connors | B65H 3/0661 271/145 |
| 2004/0207144 | A1 * | 10/2004 | Kanome | B65H 3/44 271/9.01 |
| 2005/0006835 | A1 | 1/2005 | Teo et al. | |
| 2012/0306145 | A1 * | 12/2012 | Chen | B65H 1/02 271/9.01 |

* cited by examiner

SHEET FEEDING APPARATUS

BACKGROUND

Technical Field

The present invention generally relates to a sheet feeding apparatus, and more specifically relates to a sheet feeding apparatus capable of feeding media of a plurality of sizes.

Related Art

Conventional sheet feeding apparatuses are capable of feeding media of a plurality of sizes (for example, refer to Patent Literature 1).

The above Patent Literature 1 discloses a sheet feeding apparatus including a sheet feed tray, a casing, and a cover. The casing has a first sheet feeding port placed along the sheet feed tray. The first sheet feeding port is an inlet portion for inserting large sheet. The cover is configured to be able to open and close, and to cover the first sheet feeding port when it is closed. In addition, the cover has a second sheet feeding port where small sheet can be inserted and fed while it is closed. Further, the cover is placed along the sheet feed tray while it is open, and is configured such that the upper part of the cover rotates away from the sheet tray and closes it when switching from open to a closed position. By so doing, small sheet can be fed from the second sheet feeding port.

Patent Literature 1: Japanese Unexamined Patent Application Publication No. 2005-41213

However, the sheet feeding apparatus described in Patent Literature 1 has the disadvantage that if large sheet is inserted in the first sheet feeding port (the large sheet is placed in the sheet feed tray), the cover cannot be closed (first sheet feeding port is blocked) and the large sheet must be removed. As a result, in order to feed small sheet from the second sheet feeding port of the cover, the large sheet must be unloaded to load the small sheet and the cover must be closed temporarily, which increases the amount of work when loading sheet differing in size from the sheet already loaded.

SUMMARY

One or more embodiments of the present invention provide a sheet feeding apparatus that can easily switch between media of different sizes when one medium has already been loaded.

A sheet feeding apparatus according to one or more embodiments of the present invention may include a casing provided with a sheet feeding port, a first sheet feed tray in which a first medium is loaded, the tray being placed along the sheet feeding port, and a cover that covers the sheet feeding port by rotating from a position opposite the first sheet feed tray of the casing to a side of the first sheet feed tray. The cover includes a second sheet feed tray capable of loading a second medium differing in size from the first medium to the sheet feeding port by covering the sheet feeding port.

In a sheet feeding apparatus according to one or more embodiments of the present invention, the cover covering the sheet feeding port is provided by rotating from the position opposite the first sheet feed tray of the casing to the side of the first sheet feed tray, and the second sheet feed tray capable of being loaded with a second medium differing in size from the first medium is provided by covering the sheet feeding port. As a result, because it is closed on the side of the first sheet feed tray, the cover can be closed without interfering with the first medium even if the first medium was loaded in the first sheet feed tray. Therefore, the second medium differing in size from the first medium that is already loaded can be loaded easily because the second medium is loaded in the second sheet feed tray of the cover in a feedable state without removing the first medium.

In a sheet feeding apparatus according to one or more embodiments of the present invention, preferably, the cover is configured such that it can open and close the sheet feeding port, and the second sheet feed tray is configured such that the second medium can be loaded in a state where the first medium has been loaded in the first sheet feed tray and the cover is closed. If configured in this way, the first medium can be loaded easily in the sheet feed tray by opening the cover, and then the second medium differing in size from the first medium that was already loaded is loaded by closing the cover.

In a sheet feeding apparatus according to one or more embodiments of the present invention, if configured in this way, preferably, the second sheet feed tray can be provided easily in the cover because the second medium is smaller than the first medium.

In a sheet feeding apparatus according to one or more embodiments of the present invention, the second feed tray includes a contact part that contacts the first medium or the first sheet feed tray, and a medium insertion part into which the second medium is inserted, the medium insertion part being located on the side of the contact part opposite to the first sheet feed tray. If configured in this way, a foreign object can be kept from penetrating between the cover and the first sheet feed tray by making the contact part come in contact with the first sheet feed tray (first medium), and bringing the cover closer to the first sheet feed tray.

In this case, the contact part forms the surface contacting the first medium is formed in a convex curved shape toward the first sheet feed tray side when viewed from the side. If configured in this way, damage to the first medium by the cover can be limited when the contact part is unintentionally pushed onto the first medium or when sheet is being fed.

A second sheet feed tray according to one or more embodiments of the present invention may include a contact part and a medium insertion part. The contact part has an idler roller which is rotated when the first medium is fed. If configured in this way, the friction produced between the cover and the first medium can be reduced through the idler roller.

A second sheet feed tray according to one or more embodiments of the present invention may include a contact part and a medium insertion part. The cover is provided at the end of the second sheet feed tray on the side opposite the side the first sheet feed tray, and has a wall extending in a direction away from the medium insertion part. If configured in this way, the wall can keep foreign objects from penetrating into the medium insertion part.

A second sheet feed tray according to one or more embodiments of the present invention may include a contact part and a medium insertion part. The medium insertion part has a back support part that extends to the back side of the loaded second medium, and supports the second medium from the back side. If configured in this way, the second medium is stable and maintained in the prescribed location because the second medium is supported by the back support part.

A second sheet feed tray according to one or more embodiments of the present invention may include a contact part and a medium insertion part. The cover has a first guide part which is at a right angle to the sheet feeding direction, and moves in the width direction in which the first sheet feed tray extends, and adjusts the position of the second medium in the width direction. If configured in this way, the position of the medium can be adjusted by the first guide part to be able to correspond to the various sizes of media to be fed.

A second sheet feed tray according to one or more embodiments of the present invention may include a contact part and a medium insertion part. The contact part is formed such that it projects to the upstream side of the sheet feeding direction. If configured in this way, the contact part can be used as a marker when the second medium is loaded because the user can easily recognize the contact part.

A second sheet feed tray according to one or more embodiments of the present invention may include a contact part and a medium insertion part. The medium insertion part has a through hole which penetrates the cover, or a cutout part cut away from the first sheet feed tray side.

The medium insertion part comprises a through hole or a cutout part at a right angle to the sheet feeding direction, and the length of the through hole or the cutout part is slightly longer than the length of the second medium in the width direction in which the first sheet feed tray extends. If configured in this way, the second medium can be loaded in the prescribed feeding position simply by inserting the second medium to the through hole or the cutout part.

A second sheet feed tray according to one or more embodiments of the present invention may include a contact part and a medium insertion part. The first sheet feed tray is at a right angle to the feeding direction and includes a second guide part which moves in the width direction in which the first sheet feed tray extends, to adjust the position of the first medium in the width direction, and the cover includes a projection part which projects to the side of the first sheet feed tray. The projection part contacts the second guide part when the position of the second guide overlaps with the second supply feed tray in the width direction. If configured in this way, the projection part can be prevented from contacting the first medium by putting the projection part in contact with the second guide part.

A second sheet feed tray according to one or more embodiments of the present invention may include a contact part and a medium insertion part. The medium insertion part is at a right angle to the feeding direction, and provided at one side of the first sheet feed tray or at the center of the first sheet feed tray. If configured in this way, a medium differing in size from the medium already loaded can be loaded easily even if the location of the sheet feed roller is either at one side or at the center in the width direction.

According to one or more embodiments of the present invention, a sheet feeding apparatus capable of easily loading a medium differing in size from the medium already loaded can be provided.

DETAILED DESCRIPTION

Embodiments of the present invention will be described in detail below with reference to the drawings. In the following description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

(First Embodiment)

A configuration of an image forming apparatus 100 according to a first embodiment of the present invention will be described with reference to FIGS. 1 to 4. The image forming apparatus 100 is an example of the "sheet feeding apparatus."

(Configuration of the Image Forming Apparatus)

Figure 1:
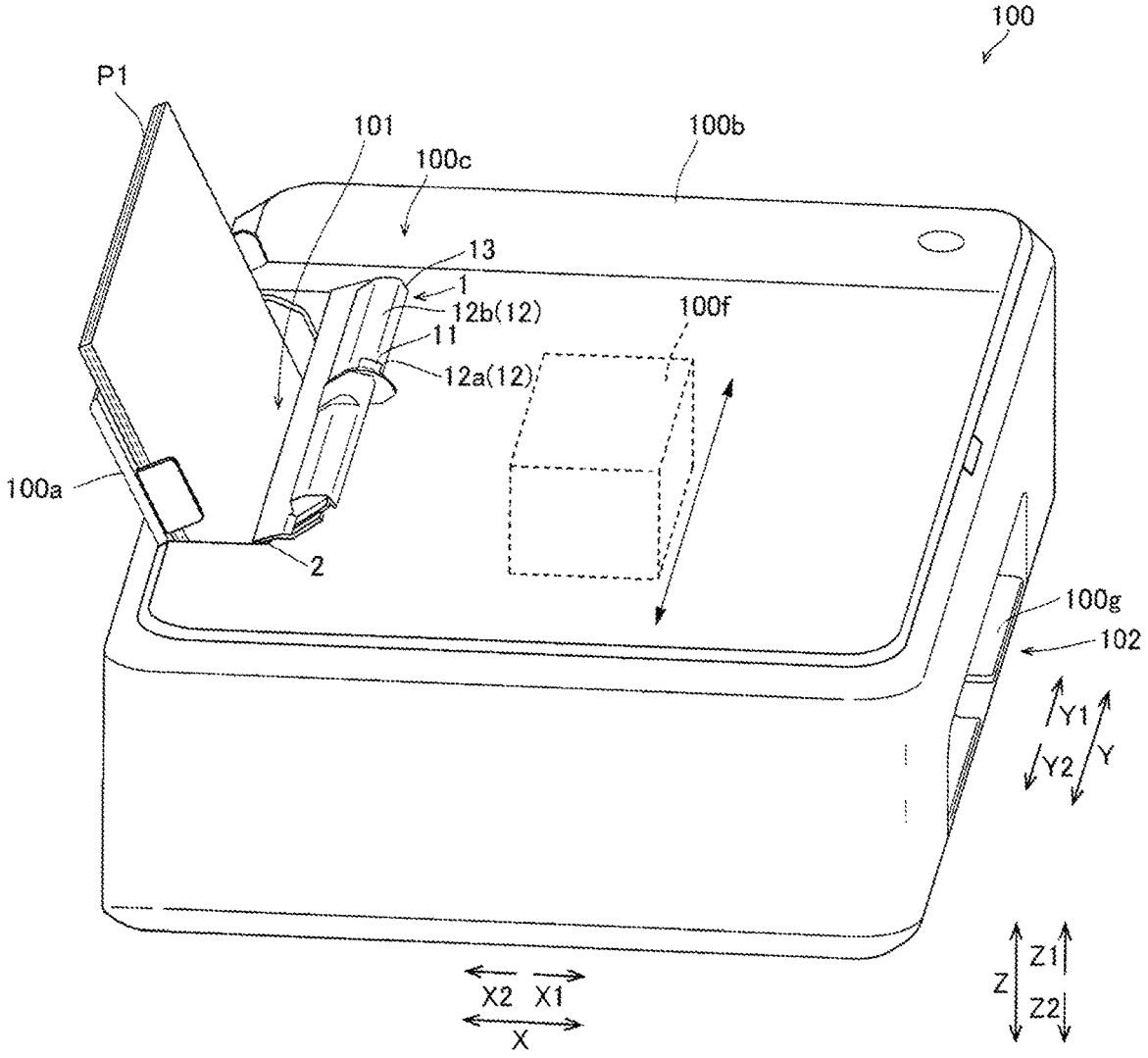
FIG. 1 is a perspective view showing the whole configuration of the image forming apparatus according to a first embodiment of the present invention.
Figure 2:
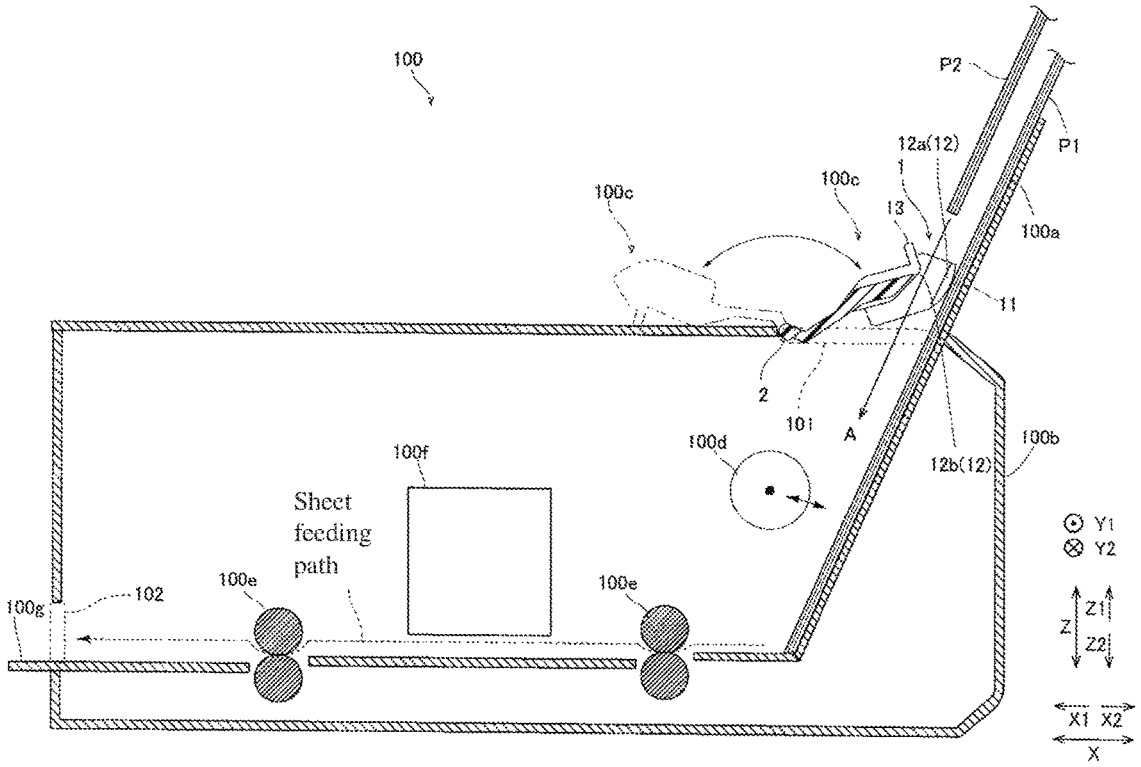
FIG. 2 is a schematic cross-sectional view of the whole configuration of the image forming apparatus according to the first embodiment of the present invention.

The image forming apparatus 100 according to the first embodiment of the present invention is equipped with a sheet feed tray 100*a*, a casing 100*b* and a cover 100*c* as shown in FIG. 1. In addition, the image forming apparatus 100 has a sheet feed roller 100*d*, a conveyance roller 100*e*, a printing part 100*f*, and a sheet ejection tray 100*g* inside the casing 100*b* as shown in FIG. 2. The sheet feed tray 100*a* is an example of the "first sheet feed tray" of the Claims.

In the description given below, the direction of drive of the printing part 100*f* (the width direction in which the sheet feed tray 100*a* extends, orthogonal to the sheet feeding direction) is taken to be the Y direction, and on the printing face (the face opposing the printing part 100*f*), the direction orthogonal to the Y direction is taken to be the X direction (direction in which the sheet feeding path extends as shown in FIG. 2), and the direction orthogonal to the X direction and the Y direction is taken to be the Z direction (vertical direction).

The sheet feeding port 101 is provided on the X2 direction side of the casing 100*b* and the upward side (Z1 direction side). In addition, the sheet ejection port 102 is provided on the X1 direction side of the casing 100*b*. The sheet feed tray 100*a* is loaded along the sheet feeding port 101 and is configured to be able to load the first sheet P1. It is provided on the X1 direction side of the sheet feed tray 100*a*. The sheet feeding port 101 is formed in a long, slender shape extending in the Y direction. The cover 100*c* is configured such that it can open and close the sheet feeding port 101. The first sheet P1 is an example of the "first medium" of the Claims.

The image forming apparatus 100 is configured such that the sheet (the first sheet P1 and the second sheet P2 described later) intended for printing which is loaded in the sheet feed tray 100*a* is fed along the sheet feeding path by the sheet feed roller 100*d*. The sheet feed roller 100*d* is configured to be able to move to the side of the sheet feed tray 100*a* and to the side away from the sheet feed tray 100*a* (the direction indicated by the arrow above the sheet feed roller 100*d* in FIG. 2). In addition, the image forming apparatus 100 is configured such that the sheet being fed is conveyed along the sheet feeding path through the conveyance roller 100*e*. Further, the image forming apparatus 100 is configured to print a prescribed image on the sheet through the printing part 100*f* while being conveyed. Furthermore, the image forming apparatus 100 is configured such that the sheet on which the prescribed image was printed is ejected from the sheet ejection port 102 mounted on the sheet ejection tray 100*g*. The second sheet P2 is an example of the "second medium" of the Claims.

The image forming apparatus 100 is configured to be able to load the first sheet P1 and the second sheet P2, which are of different sizes from each other. The first sheet P1 is loaded along the sheet feed tray 100*a*. In addition, the first sheet P1 is loaded (inserted) from the sheet feeding port 101 when the cover 100*c* is open. The second sheet P2 is loaded along the loaded first sheet P1. Specifically, the second sheet P2 is loaded along the top-most sheet of the loaded first sheet P1. When the first sheet P1 has not been loaded, the second sheet P2 is loaded along the sheet feed tray 100*a*. In addition, the second sheet P2 is loaded (inserted) from the sheet loading part 1 (cutout part 12*b* described later), which is described below, of the cover 100*c*. Further, the second sheet P2 is smaller in the Y direction than the largest first sheet P1 that can be loaded in the sheet feed tray 100*a*. The sheet loading part 1 is an example of the "second sheet feed tray" of the Claims.

(Configuration of the Cover)

Figure 3:
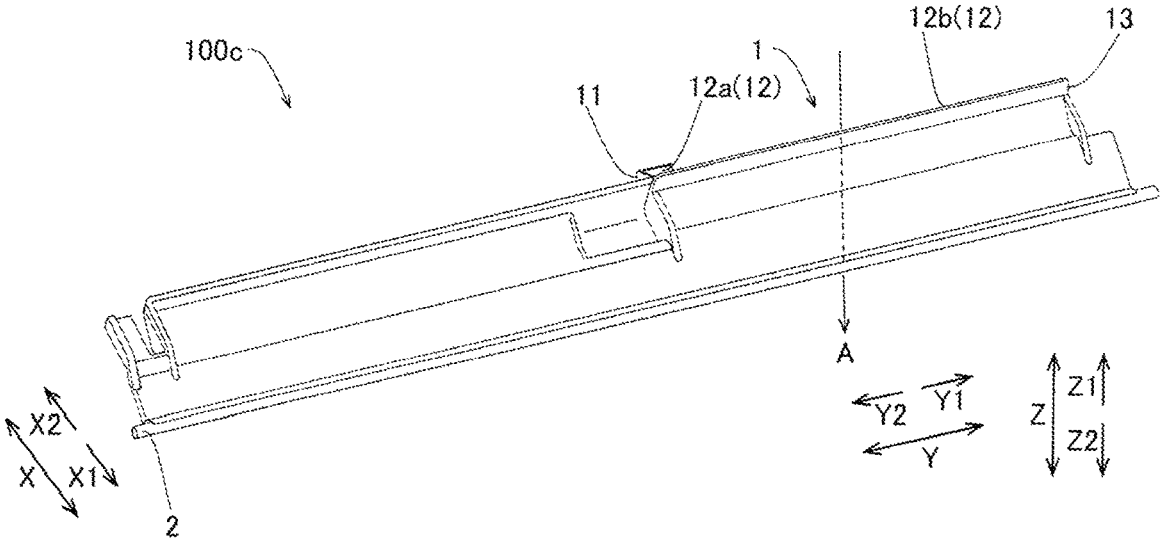
FIG. 3 is a perspective view showing the closed cover of the image forming apparatus according to the first embodiment of the present invention.
Figure 4:
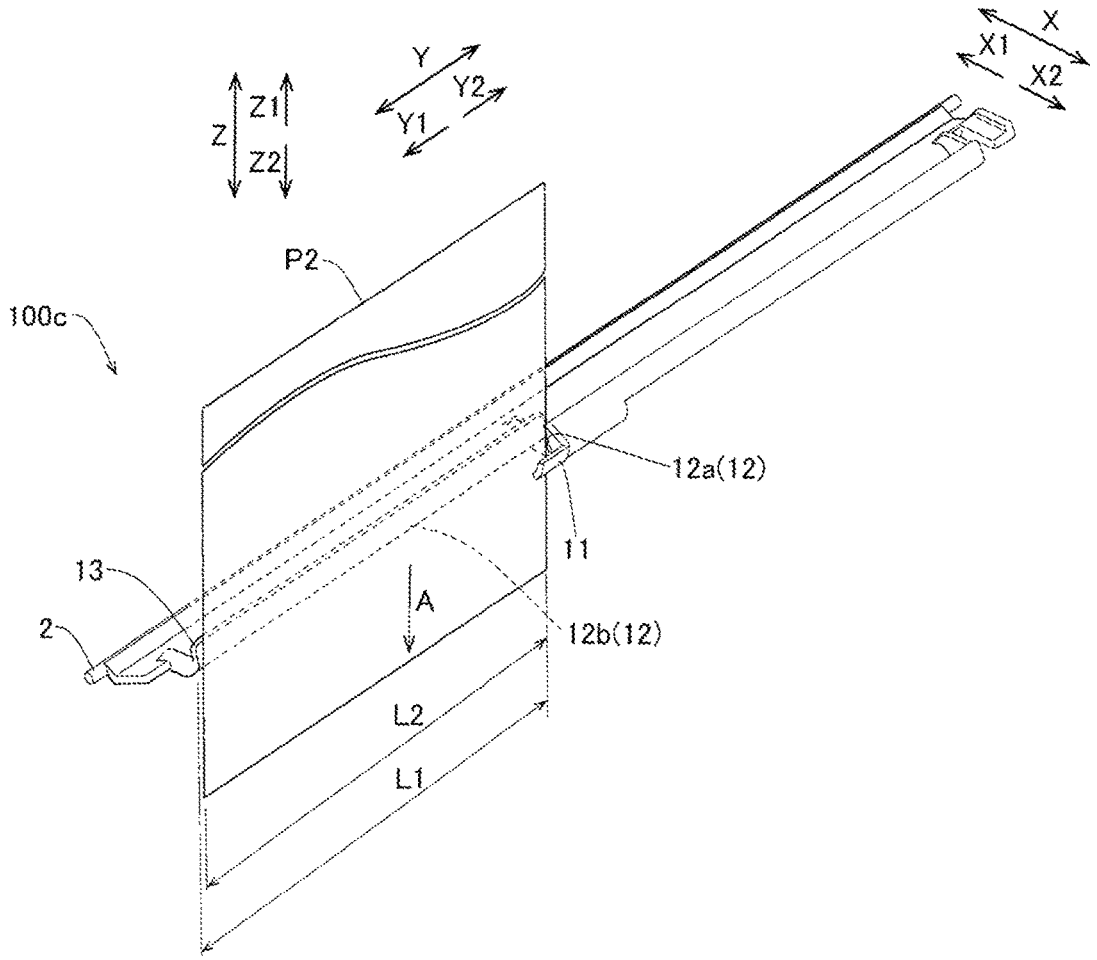
FIG. 4 is a perspective view showing the state where the second sheet has been inserted into the closed cover of the image forming apparatus according to the first embodiment of the present invention.

By covering the sheet feeding port 101 as shown in FIG. 2, the cover 100*c* is configured to keep foreign objects such as a pen, or the like, from penetrating into the casing 100*b*. The cover 100*c* comprises the sheet loading part 1 and a shaft portion 2, as shown in FIGS. 3 and 4.

The shaft portion 2 is arranged near the end of the front side of the sheet feeding port 101 (the opposite side as the sheet feed tray 100*a*) as shown in FIG. 2. In addition, the shaft portion 2 extends in the Y direction. The cover 100*c* is attached to the casing 100*b* via the shaft portion 2 so as to be able to rotate. As a result, the cover 100*c* is configured such that it can open and close the sheet feeding port 101 as described above by rotating centered around the shaft portion 2. In FIG. 2, a solid line shows the cover 100*c* in the closed state, and a dot-dash line (imaginary line) shows the cover 100*c* in the open state. The cover 100*c* is configured to cover the sheet feeding port 101 by rotating (closing) from the position opposite to the sheet feed tray 100*a* of the casing 100*b* to the side of the sheet feed tray 100*a*. In addition, the cover 100*c* comprises the sheet loading part 1, which enables the second sheet P2 differing in size from the first sheet P1 to be loaded in the sheet feeding port 101 by covering the sheet feeding port 101.

The sheet loading part 1 in the first embodiment of the present invention is configured such that the second sheet P2 differing in size from the first sheet P1 can be loaded (inserted) from the sheet feeding port 101 in the state where the first sheet P1 has been loaded in the sheet feeding port 100*a*. In addition, the sheet loading part 1 is configured such that the second sheet P2 can be loaded even when the first sheet P1 has been loaded in the sheet feed tray 100*a* and the cover 100*c* is closed. Further, the sheet loading part 1 comprises a contact part 11, a sheet insertion part 12 and a wall 13. The sheet insertion part 12 is an example of the "medium insertion part" of the Claims.

The contact part 11 is configured to make contact with the first sheet P1 or the sheet feed tray 100*a* when the cover 100*c* is closed. In addition, when the cover 100*c* is closed, the contact part 11 projects in the X2 direction from the end of the X2 direction side of the cover 100*c*, and is part of the X2 direction side of a part which is formed in an L shape extending from the projected end to the Y direction side, as shown in FIG. 4. In viewed from the side (looking from the Y direction), the face on the X2 direction side which is the side touching the first sheet P1 is formed in a convex curved shape towards the side of the sheet feed tray 100*a* in the contact part 11, as shown in FIG. 2. Specifically, the face on the X2 direction side of the contact part 11 has an arc shape when viewed from the side (looking from the Y direction). As a result, the contact part 11 (cover 100*c*) is configured to come in contact with the surface of the first sheet P1 by pressing the first sheet P1 by dead weight when the cover is closed. The contact part 11 is not limited to the surface on the X2 direction side which is the side in contact with the first sheet P1, and may be configured, for example, by attaching another part such as the roller as the part that comes in contact with the first sheet P1.

The sheet insertion part 12 is positioned on the opposite side (X1 direction side) of the contact part 11 as the sheet feed tray 100*a* side, and is the portion where the second sheet P2 is inserted. In addition, the sheet insertion part 12 has a back support 12*a* and a cutout part 12*b*. Further, the sheet insertion part 12 is at a right angle to the sheet feeding direction and is provided on one side of the sheet feed tray 100*a* in the width direction (Y direction) in which the sheet feed tray 100*a* extends.

When the cover 100*c* is closed, the back support 12*a* projects in the X2 direction from the end on the X2 direction side of the cover 100*c*, and is the portion on the X1 direction side of the portion formed in an L shape extending from the projected end to the Y direction side, as shown in FIG. 4. In addition, when the cover 100*c* is closed, the back support 12*a* is configured to extend to the back side (X2 direction side) of the loaded second sheet P2 and to support the second sheet P2 from the back side. Further, the back support part 12*a* is configured to come into contact with the neighboring part at the end on the Y2 direction side of the loaded second sheet P2.

The cutout part 12*b* is the part that is cut out from the sheet feed tray 100*a* side (X direction side) in the cover 100*c*. The cutout part 12*b* is provided on the X2 direction side of the cover 100*c* and at the end on the Y1 direction side. Specifically, the cutout part 12*b* is formed by cutting out the X2 direction side and the Y1 direction side of the cover 100*c* in the closed state as shown in FIG. 4. An insertion port (space) into which the second sheet P2 can be inserted is formed by this cutout part 12*b* in the cover 100*c* when it is closed. The second sheet P2 is inserted in the cutout part 12*b* (space) by being moved from the upper side (the Z1 direction side) of the cutout part 12*b* in the A direction (insertion direction of the second sheet P2) when the 100*c* is closed, and loaded into the imaging device 100 together with the first sheet P1. The cutout part 12*b* is located above the sheet feeding port 101 (Z1 direction) when the cover 100*c* is closed, as shown in FIG. 2.

In addition, as shown in FIG. 4, the length L1 of the cutout part 12*b* is slightly longer than the length L2 of the second sheet P2 in the Y direction. In other words, the second sheet P2 of a prescribed size can be inserted in the cutout part 12 and has a prescribed size that can regulate movement in the Y direction.

A wall 13 is provided on the end of the side (X1 direction side) of the cutout part 12*b* (sheet loading part 1) opposite the sheet feed tray 100*a*, as shown in FIG. 2. In addition, the wall 13 extends to the direction (substantially upward) away from the cutout part 12*b* (sheet insertion part 12) when the cover 100*c* is closed. Further, the wall 13 is provided along the cutout part 12*b*. Furthermore, the wall 13 is provided substantially in the range in which the cutout part 12*b* is provided in the Y direction as shown in FIG. 4.

The following effect can be obtained in the first embodiment of the present invention.

As described above, in the first embodiment of the present invention, the cover 100*c* rotates from a position opposite the sheet feed tray 100*a* (first sheet feed tray) of the casing 100*b* to a side of the sheet feed tray 100*a* and covers the sheet feeding port 101. The cover 100*c* includes the sheet loading part 1 (second sheet feed tray) so that the second sheet P2 differing in size from the first sheet P1 can be loaded in the sheet feeding port 101 by covering the sheet feeding port 101. That is, the sheet loading part 1 causes the second sheet P2 differing in size from the first medium to be capable of being loaded in the sheet feeding port 101 when the cover 100*c* covers the sheet feeding port 101. As a result, the cover 100*c* can be closed without interfering with the first sheet P1 even if the first sheet P1 is loaded in the sheet feed tray 100*a* because the cover 100*c* is closed at the side of the sheet feed tray 100*a*. Therefore, the second sheet P2 differing in size from the first sheet P1 that is already loaded can be loaded easily because it is loaded in the sheet loading part 1 of the cover 100*c* in a state where the second sheet P2 can be fed without removing the first sheet P1.

In addition, as described above in the first embodiment of the present invention, the cover 100*c* is configured to be able to open and close the sheet feeding port 101, and the sheet loading part 1 is configured to be able to install the second sheet P2 in a state where the first sheet P1 is loaded in the sheet feed tray 100*a* and the cover 100*c* is closed. As a result, the first sheet P1 can be loaded easily in the sheet feed tray 100*a* by opening the cover 100*c*, and then the second sheet P2 differing in size from the first sheet P1 that is already loaded can be loaded easily by closing the cover 10*c*.

In addition, as described above in the first embodiment of the present invention, the second sheet P2 is smaller in the width direction (Y direction) than the largest first sheet P1 that can be loaded in the sheet feed tray 100*a*. As a result, the sheet loading part 1 can be provided easily in the cover 100*c* because the second sheet P2 is smaller than the first sheet P1.

In addition, as described above in the first embodiment of the present invention, the contact part 11, which comes in contact with the first sheet P1 or the sheet feed tray 100*a*, and the sheet insertion part 12, into which the second sheet P2 is inserted located on the side of the contact part 11 opposite the sheet feed tray 100*a*, are provided in the sheet loading part 1. As a result, a foreign object can be kept from penetrating between the cover 100*c* and the sheet feed tray 100*a* by making the contact part 11 contact the sheet feed tray 100*a* (first sheet P1) and bringing the cover 100*c* close to the sheet feed tray 100*a*. In addition, since the sheet insertion part 12 is close to the first sheet P1, the second sheet P2 can be supported from the back side by the first sheet P1 and the sheet feed tray 100*a*, and therefore the second sheet P1 can be kept from bending even if the second sheet P2 is not resilient (when the second sheet P2 is formed from a material that easily bends). As a result, defective sheet feeding can be kept from occurring.

In addition, as described above in the first embodiment, when viewed from the side, the surface of the contact part 11 which contacts the first sheet P1 forms a convex curved shape towards the side of the sheet feed tray 100*a*. As a result, damage to the first sheet P1 by the cover 100*c* can be prevented when the contact part 11 is pushed unintentionally onto the first sheet P1 or when sheet is being fed.

In addition, as described above in the first embodiment of the present invention, the cover 100*c* is loaded at the end of the sheet loading part 1 on the side opposite to the sheet feed tray 100*a*, and the wall 13 is provided extending in the direction away from the sheet insertion part 12. As a result, a foreign object can be kept from penetrating into the sheet insertion part 12 because of the wall 13.

In addition, as described above in the first embodiment of the present invention, the loaded second sheet P2 extends to the back side of the second sheet P2, and the back support part 12*a* which supports the second sheet P2 from the backside is provided in the sheet insertion part 12. As a result, the second sheet P2 can be stably maintained in the prescribed location because the second sheet P2 is supported by the back support part 12*a*. In addition, because of the back support part 12*a*, the second sheet P2 can be prevented from mixing in with the first sheet P1 in the gaps between the first sheet P1 and the contact part 11. In short, the second sheet P2 can be loaded in the appropriate location.

In addition, as described in the first embodiment of the present invention, the length of the cutout part 12*b* is slightly longer than the length of the second sheet P2 in the width direction (Y direction). As a result, the second sheet P2 can be loaded in the prescribed sheet feeding position simply by inserting the second sheet P2 in the cutout part 12*b*.

(Second Embodiment)

A image forming apparatus 200 of the second embodiment will described below with reference to FIGS. 5 and 6. The second embodiment of the present invention is different from the first embodiment of the present invention in that the contact part 11, which is the surface of the back support part 12*a* on the sheet feed tray 100*a* side, contacts the first sheet P1. An example of an idler roller 3 that contacts the first sheet 1 will be described. The image forming apparatus 200 is an example of the "sheet feeding apparatus" of the Claims. In addition, the idler roller 3 is an example of the "contact part" of the Claims.

Figure 5:
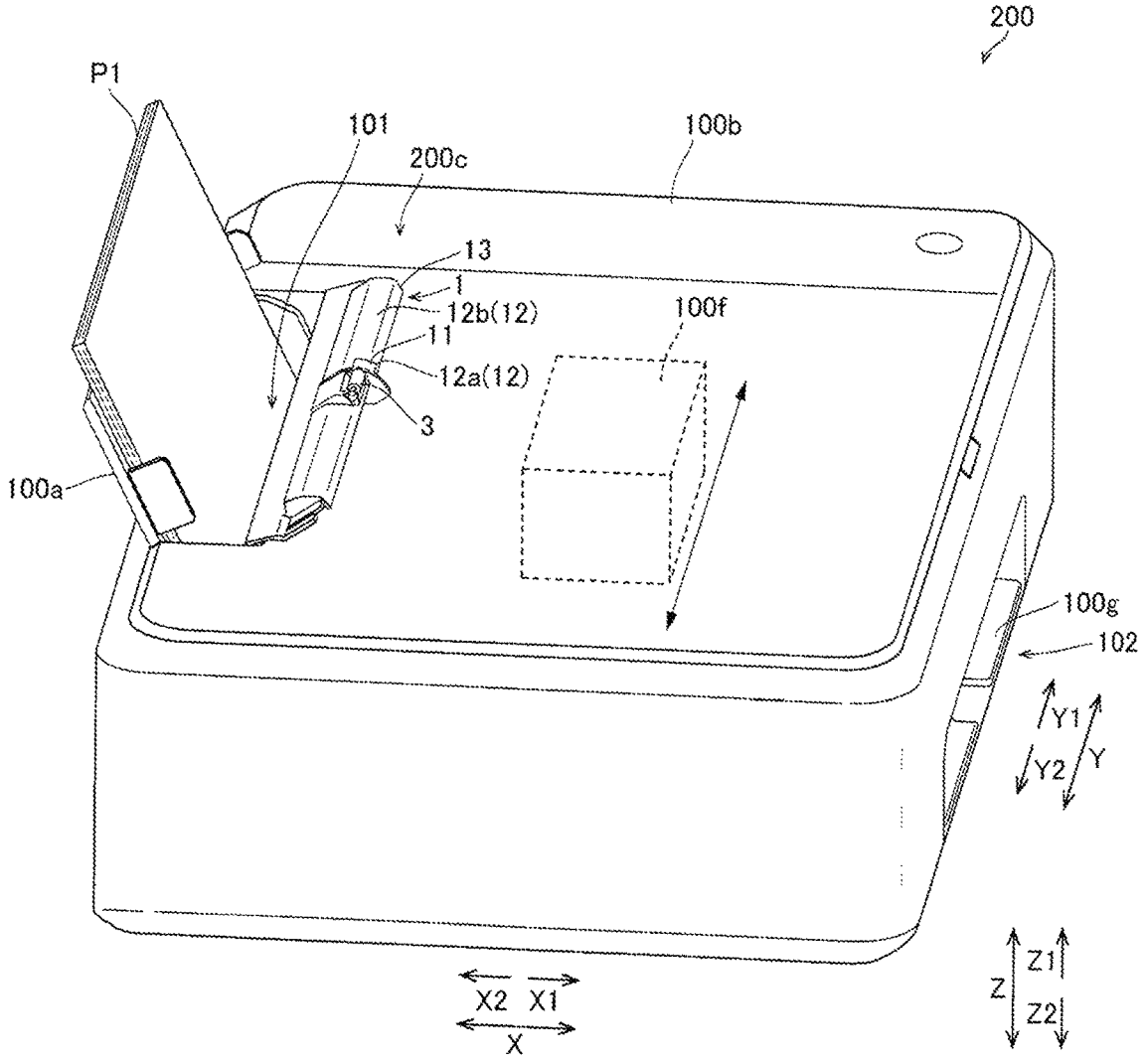
FIG. 5 is a perspective view showing the whole configuration of the image forming apparatus according to a second embodiment of the present invention.

As shown in FIG. 5, the image forming apparatus 200 of the second embodiment of the present invention is equipped with a cover 200*c* (sheet loading part 1) containing an idler roller 3.

(Configuration of the Cover)

Figure 6:
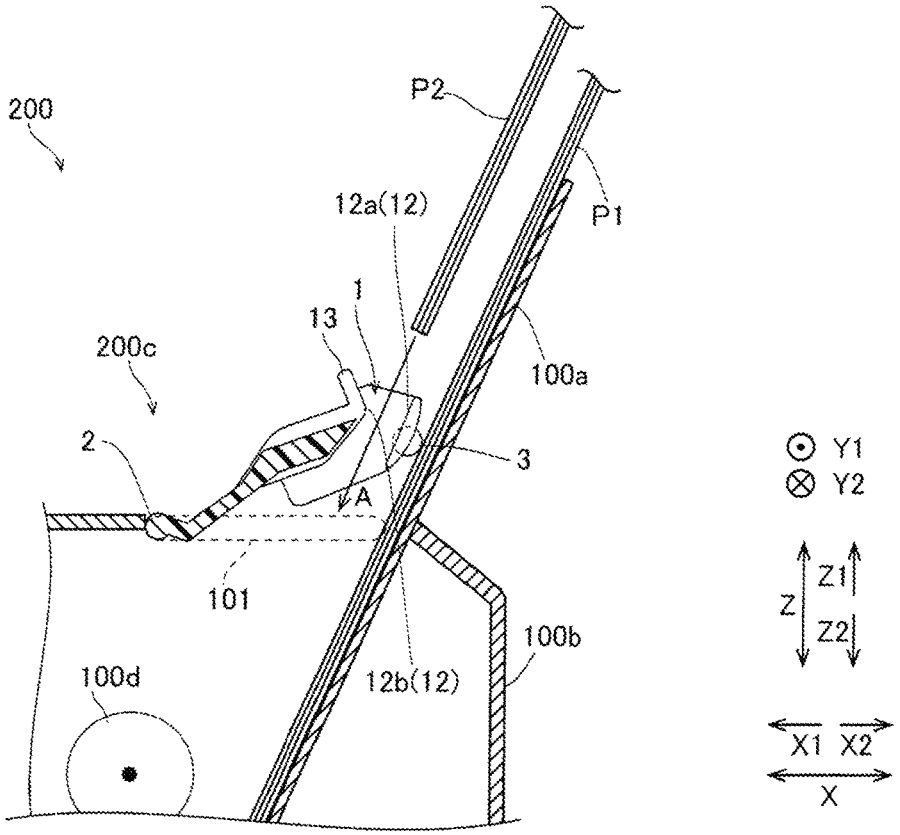
FIG. 6 is a schematic cross-sectional view showing a part of the image forming apparatus according to the second embodiment of the present invention.

As shown in FIG. 6, the idler roller 3 is provided on the sheet feed tray 100*a* side that is substantially in the center in the lengthwise direction of the cover 200*c*. In addition, the idler roller 3 has a rotating center shaft (not shown in the drawing) extending in the Y direction. In other words, the rotating center shaft of the idler roller 3 is parallel to the shaft portion 2 of the cover 200*c*. Further, the idler roller 3 is located closest to the sheet feed tray 100*a* side in each part constituting the cover 200*c* when the cover 200*c* is in the closed state. In other words, the idler roller 3 is configured to be in contact with the first sheet P1 when the cover 200*c* is closed and the first sheet P1 is loaded. Also, the idler roller 3 is configured to be rotated (driven) by the first sheet P1 that is moved when the first sheet P1 is fed (when the first sheet P1 is sent downstream of the sheet feeding path by the sheet feed roller 100*d*). Therefore, the idler roller 3 reduces the frictional force produced between the cover 200*c* and the first sheet P1.

A configuration of the second embodiment of the present invention is otherwise the same as that of the first embodiment of the present invention.

The following effect can be obtained in the second embodiment of the present invention.

As described above in the second embodiment of the present invention, the idler roller 3 that is rotated when the first sheet P1 is fed is provided. As a result, the frictional force produced between the cover 200*c* and the first sheet P1 can be reduced by the idler roller 3.

The effect of the second embodiment of the present invention is otherwise the same as that of the first embodiment of the present invention.

(Third Embodiment)

A image forming apparatus 300 of a third embodiment of the present invention will be described with reference to FIGS. 7-10. An example comprising a first guide part 4 for adjusting the position of the second sheet P2 in the width direction (Y direction) is described in this third embodiment of the present invention in addition to the configuration of the second embodiment of the present invention. The cover 300*c* is an example of the "penetration suppression part" of the Claims. In addition, the image forming apparatus 300 is an example of the "sheet feeding apparatus" of the Claims.

Figure 7:
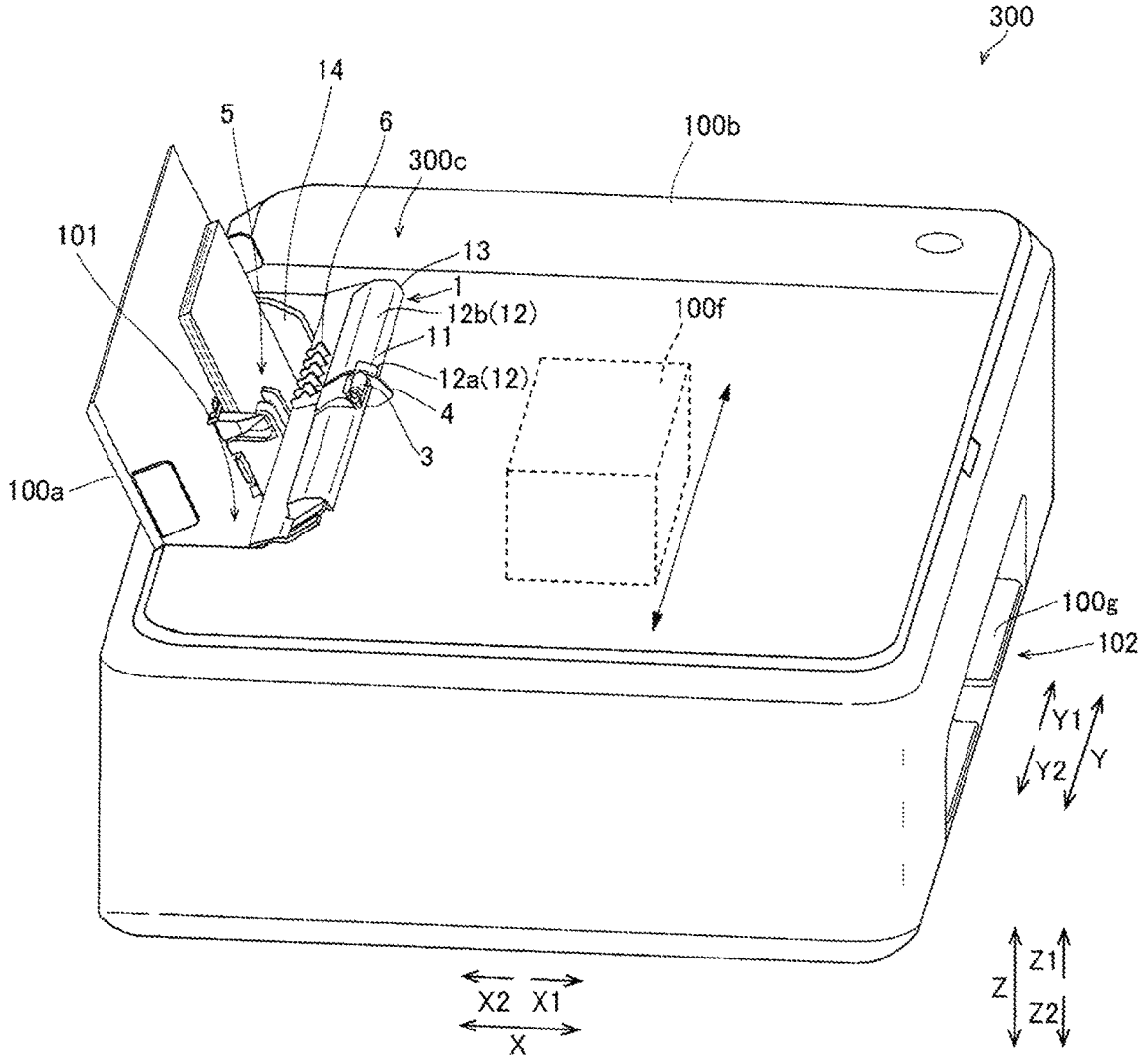
FIG. 7 is a perspective view showing the whole configuration of the image forming apparatus according to a third embodiment of the present invention.

As shown in FIG. 7, the image forming apparatus 300 of the third embodiment of the present invention includes a cover 300*c* containing the first guide part 4 (refer to FIG. 8) and a plurality of (five) projection parts 6.

(Configuration of the Cover)

Figure 8:
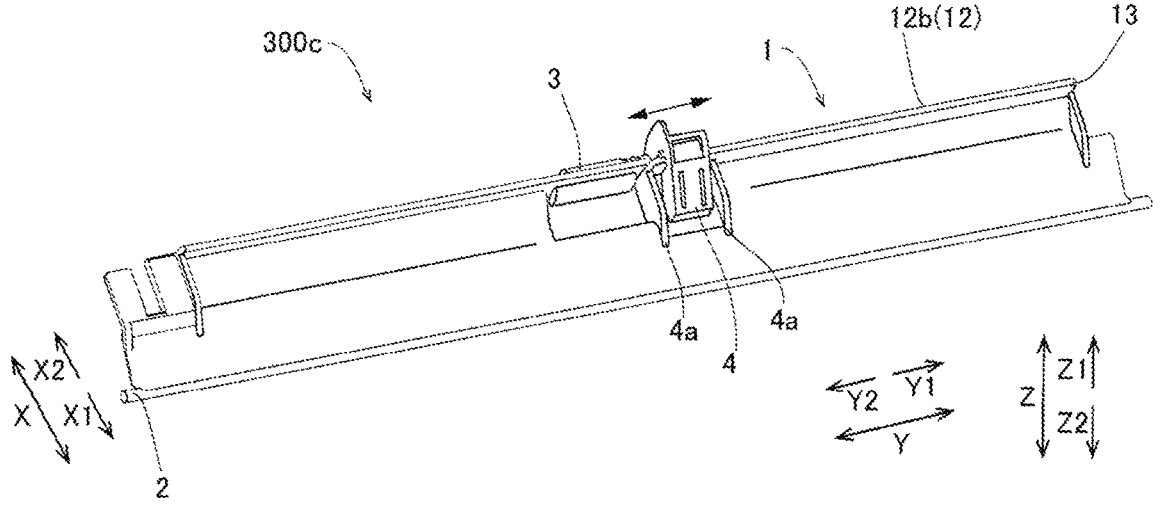
FIG. 8 is a perspective view showing the cover of the image forming apparatus according to the third embodiment of the present invention in the closed state.
Figure 9:
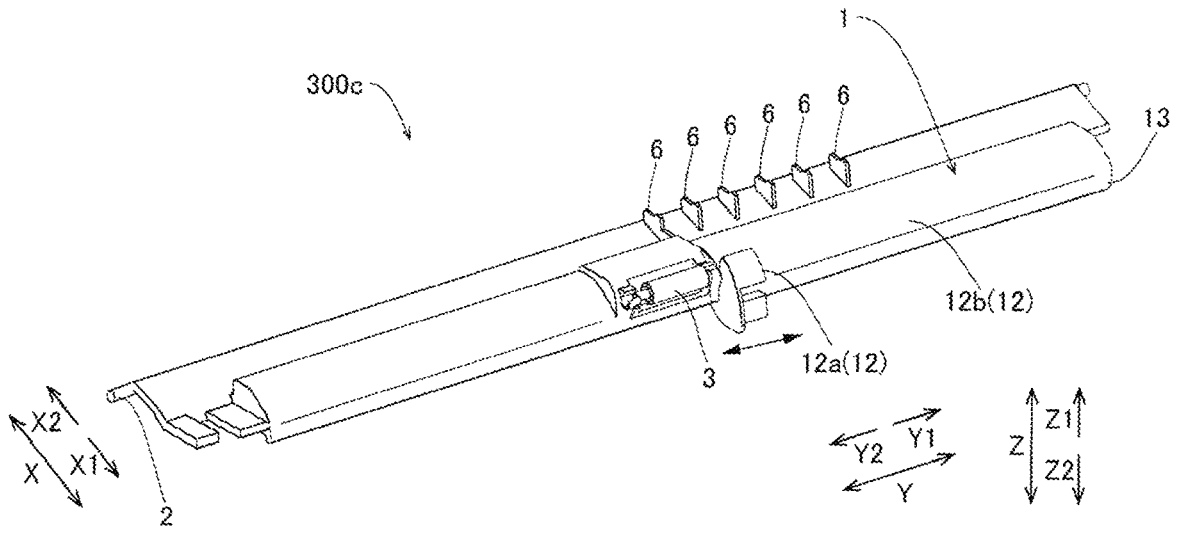
FIG. 9 is a perspective view showing the cover of the image forming apparatus according to the third embodiment of the present invention in the open state.

The first guide part 4 is formed integrally with the back support part 12*a* as shown in FIG. 8 and FIG. 9. In addition, the first guide part 4 is positioned on the Y direction side of the idler roller 3 as shown in FIG. 8. Further, the first guide part 4 is configured to be able to move in the Y direction along a rail part (not shown in the drawing) extending in the Y direction that is provided in the cover 300*c*. In addition, one each of plate-like regulating parts 4*a* which regulate movement of the first guide part 4 are provided on the Y1 direction side and the Y2 direction side of the first guide part 4. The two regulating parts 4*a* are separated in the Y direction at a fixed interval. The first guide part 4 is configured to be able to move a prescribed range in the Y direction that is in between the two regulating parts 4*a* along the rail part. In addition, the first guide part 4 is configured so as to change the size of the sheet insertion part 12 in the Y direction (the space in which the cutout part 12*b* and the second sheet P2 are inserted) and to regulate the position of the second sheet P2 in the Y direction by moving in the Y direction. The first guide part 4 is moved in the Y direction manually by the user.

Specifically, the first guide part 4 is moved to a position abutting the regulating part 4*a* on the Y direction side when the second sheet P2 (refer to FIG. 7) is fed (when the second sheet P2 is inserted from the cutout part 12*b*), as shown in FIG. 7 and FIG. 8. Also, the first guide part 4 is configured to push the second sheet P2 to the side wall 14 of the casing 100*b* (refer to FIG. 7) which is positioned at the end on the Y direction side of the second sheet P2 by moving to the Y direction side when the second sheet P2 is loaded. As a result, the first guide part 4 arranges the second sheet P2 in the prescribed feeding position.

Figure 10:
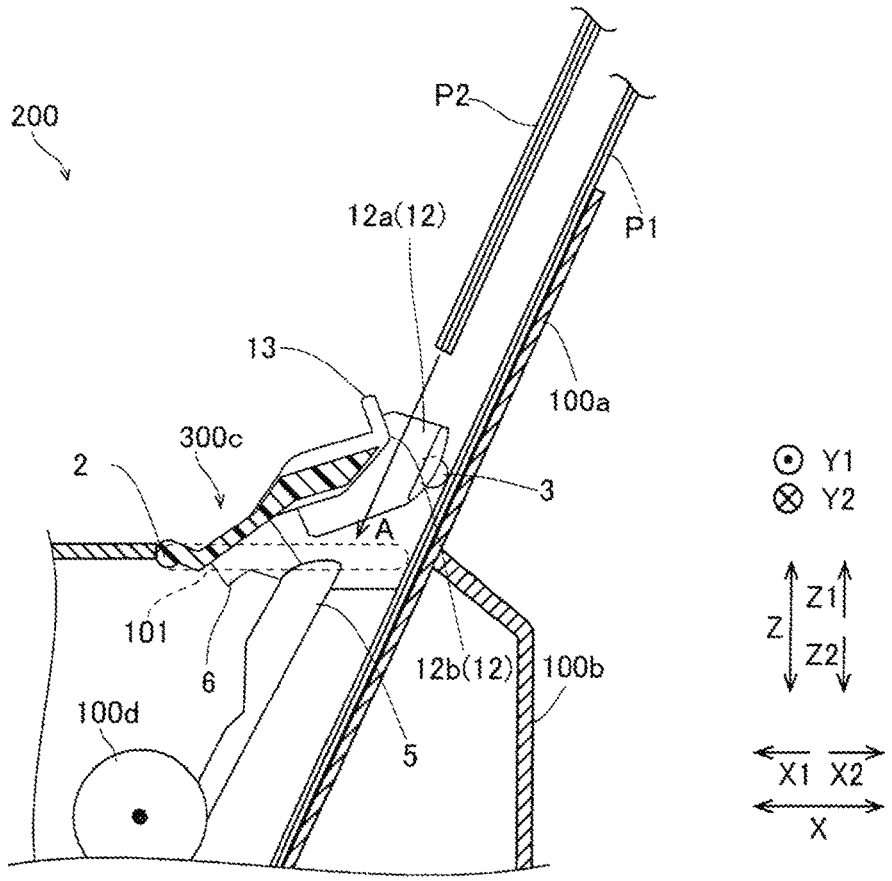
FIG. 10 is a schematic cross-sectional view showing a part of the image forming apparatus according to the third embodiment of the present invention.

The projection part 6 is formed in a flat shape extending in the direction orthogonal to the Y direction as shown in FIG. 9. In addition, a plurality of projection parts 6 are lined up at equal intervals in the Y direction. Further, the plurality of projection parts 6 are loaded nearer the Y direction side than the idler roller 3. Furthermore, a projection part 6 is provided on the side opposite the side where the wall 13 of the cover 300*c* is provided as shown in FIG. 10. In other words, in an open state, the wall 13 is positioned on the upward side of the cover 300*c* (on the Z1 direction side), and the projection part 6 is positioned on the downward side of the cover 300*c* (on the Z2 direction side).

The sheet feed tray 100*a* is configured to be able to move in the Y direction and comprises a second guide part 5 which adjusts the position of the first sheet P1 in the Y direction. The second guide part 5 is configured to push the first sheet P1 to the side wall 14 of the casing 100*b* which is positioned at the end of the first sheet P1 on the Y direction side by moving to the Y direction side when the first sheet P1 is loaded. In other words, the second guide part 5 arranges the first sheet P1 in the prescribed feeding position.

The cover 300*c* is not in contact with the first sheet P1 via the idler roller 3 when the cover 300*c* is about to position and feed the first sheet P1, which is smaller in width than the width of the second sheet P2, into the sheet feed tray 100*a*. This is because the first sheet P1 is located more toward the Y direction side than the idler roller 3. In this case, the second guide part 5 is also located in more toward the Y direction side than the idler roller 3.

In this state, the projection part 6 touches the second guide part 5 when the cover 300 is closed to keep foreign objects from penetrating into the sheet feeding port. As a result, the projection part 6 is configured to separate the idler roller 3 from the sheet feed tray 100*a* and to prevent the cover 300*c* (the portion excluding the idler roller 3) from directly contacting the first sheet P1.

The configuration of the third embodiment of the present invention is otherwise the same as that of the second embodiment of the present invention.

The following effect can be obtained in the third embodiment of the present invention.

As described above in the third embodiment of the present invention, a first guide part 4 is provided in the cover 300*c*, which is orthogonal to the sheet feeding direction and moves in the width direction in which the sheet feed tray 100*a* extends to adjust the position of the second sheet P2 in the width direction. As a result, by being able to adjust the position of the sheet using the first guide part 4, feeding of sheet of various sizes can be handled.

In addition, as described above in the third embodiment of the present invention, the second guide part 5 with moves in the width direction in which the sheet feed tray 100*a* extends to adjust the position of the first sheet 1 in the width direction is provided on the sheet feed tray 100*a*, and on the cover 300*c*, a projection part 6 which projects toward the sheet feed tray 100*a* side is provided, and they are configured to make the projection part 6 come in contact with the second guide part 5 when the position of the second guide part 5 overlaps with the sheet loading part 1 in the width direction. As a result, the projection part 6 can be prevented from making contact with the first sheet P1 by making the projection part 6 come in contact with the second guide part 5.

The effect of the third embodiment of the present invention is otherwise the same as that of the second embodiment of the present invention.

(Fourth Embodiment)

Figure 11:
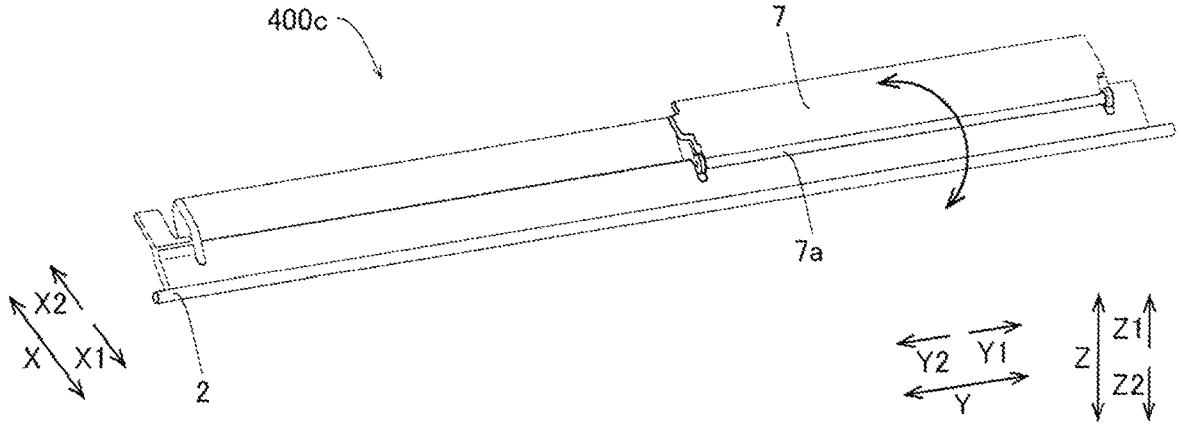
FIG. 11 is a perspective view showing the cover of the image forming apparatus according to a fourth embodiment of the present invention in the closed state.

A fourth embodiment is described below with reference to FIG. 11. An example where a cover 400*c* is equipped with an auxiliary cover part 7 in addition to the configuration of the first embodiment of the present invention is described in this fourth embodiment of the present invention. The cover 400*c* is an example of the "intrusion suppression part" of the Claims. In addition, the auxiliary cover part 7 is an example of the "cover" of the Claims.

The cover 400*c* of the fourth embodiment of the present invention includes the auxiliary cover part 7.

(Configuration of the Cover)

The auxiliary cover part 7 has a shaft portion 7*a* located parallel with the shaft portion 2 of the cover 400*c*, and is configured to be able to be opened and closed by rotating centered around the shaft portion 7*a*. In addition, the auxiliary cover part 7 is configured to block the cutout part 12*b* (refer to FIG. 1) (the space where the second sheet P2 (refer to FIG. 1) is inserted) from above by being closed. Therefore, the sheet feeding port 101 (refer to FIG. 1) is blocked by the cover 400*c* and the auxiliary cover part 7. The auxiliary cover part 7 is opened and closed manually by the user.

The configuration of the fourth embodiment of the present invention is otherwise the same as that of the first embodiment of the present invention.

The following effect can be obtained in the fourth embodiment of the present invention.

As described above in the fourth embodiment of the present invention, the auxiliary cover part 7 which can block and open and close the cutout part 12*b* is provided in the cover 400*c*. As a result, the auxiliary cover part 7 can keep a foreign object from penetrating into the sheet insertion part 12 (cutout part 12*b*) more effectively.

The configuration of the fourth embodiment of the present invention is otherwise the same as that of the first embodiment of the present invention.

(Fifth Embodiment)

Figure 12:
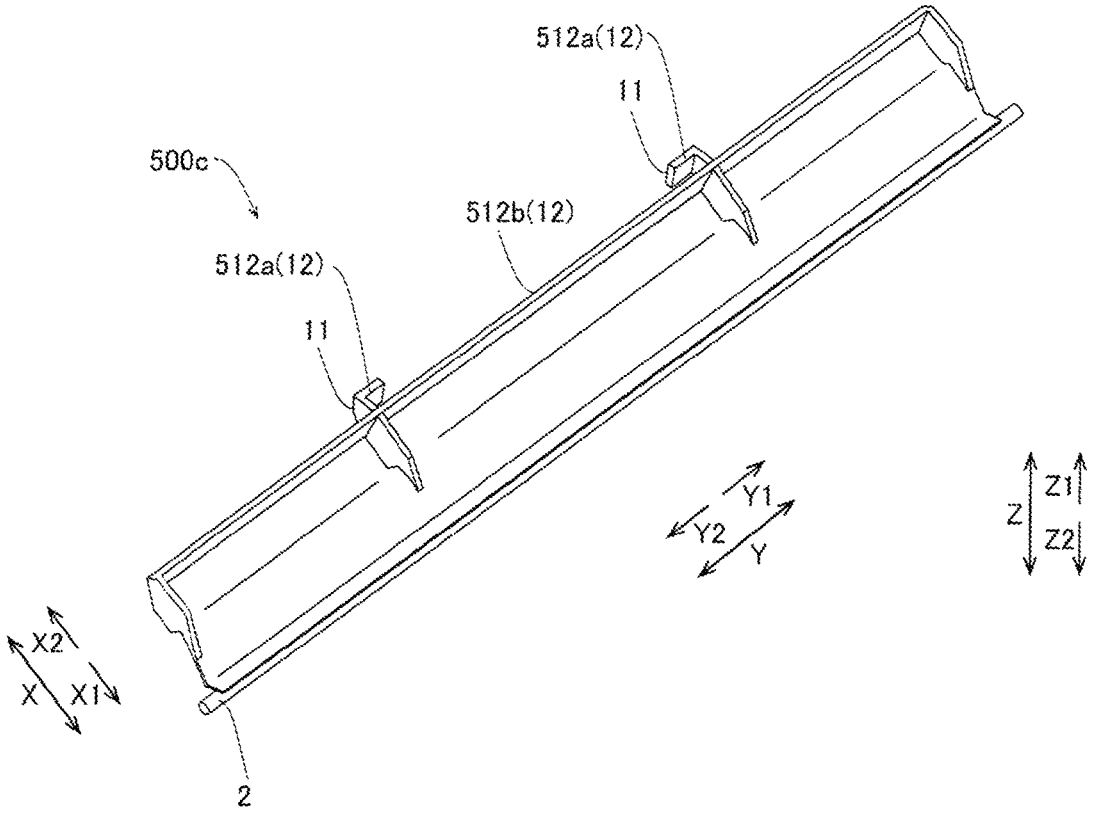
FIG. 12 is a perspective view showing the cover of the image forming apparatus according to a fifth embodiment of the present invention in the closed state.

A fifth embodiment is described below with reference to FIG. 12. In the fifth embodiment of the present invention, an example in which a cutout part 512*b* is provided in the center of the cover 500*c* in the Y direction is described. It differs from the first embodiment of the present invention in that the cutout part 12*b* is provided on one end of the cover 100*c* in the Y direction. The cover 500*c* is an example of the "invasion suppression part" of the Claims.

The cover 500*c* (sheet insertion part 12) of the fifth embodiment of the present invention includes a pair of back support parts 512*a* and the cutout part 512*b*.

(Configuration of the Cover)

The pair of back support parts 512*a* are separated from each other at a prescribed interval and are provided on the center side of the cover 500*c*. In addition, the cutout part 512*b* is provided within the pair of back support parts 512*a*. Therefore, the second sheet P2 (refer to FIG. 1) can be fed from the center of the cover 500*c*. In addition, the sheet feed roller (not shown in the drawing) is arranged downstream of the sheet feeding direction at the center of the cover 500*c* (cutout part 512*b*). FIG. 12 shows an example in which, like the first embodiment of the present invention, the cover 500*c* is not equipped with a roller that contacts the first sheet P1 as shown in the second embodiment of the present invention, but the cover 500*c* may be equipped with the roller that contacts the first sheet P1. In this case, the roller that contacts the first sheet P1 is arranged on the contact part 11.

The configuration of the fifth embodiment of the present invention is otherwise the same as that of the first embodiment of the present invention.

The following effect can be obtained in the fifth embodiment of the present invention.

As described above in the fifth embodiment of the present invention, the sheet insertion part 12 is provided in the center in the width direction (Y direction) of the sheet feed tray 100*a*. As a result, the second sheet P2 differing in size from the first sheet P1 that is already loaded can be loaded easily even when the position of the sheet feed roller 100*d* is at the center in width direction.

The configuration of the fifth embodiment of the present invention is otherwise the same as that of the first embodiment of the present invention.

(Modification Example)

One or more embodiments of the present invention above and one or more of the modified examples of one or more embodiments of the present invention may be respectively combined. Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

In addition, in the first to fifth embodiments of the present invention, examples using sheet as the first and second media of are illustrated, but the present invention is not limited thereto. In one or more embodiments of the present invention, a medium other than sheet, such as sheets used for an OHP (overhead projector) may be used as the first and second media.

In addition, in the first to fifth embodiment, examples in which the sheet feeding apparatus are used in an image forming apparatus are illustrated, but the present invention is not limited thereto. In one or more embodiments of the present invention, the sheet feeding apparatus may be used in a sheet feeding apparatus other than an image forming apparatus, such as a scanner.

In addition, an example in which five projection parts is shown in the third embodiment, but the present invention is not limited thereto. In the present invention, one to four pieces or six or more projection parts may be provided.

Figure 13:
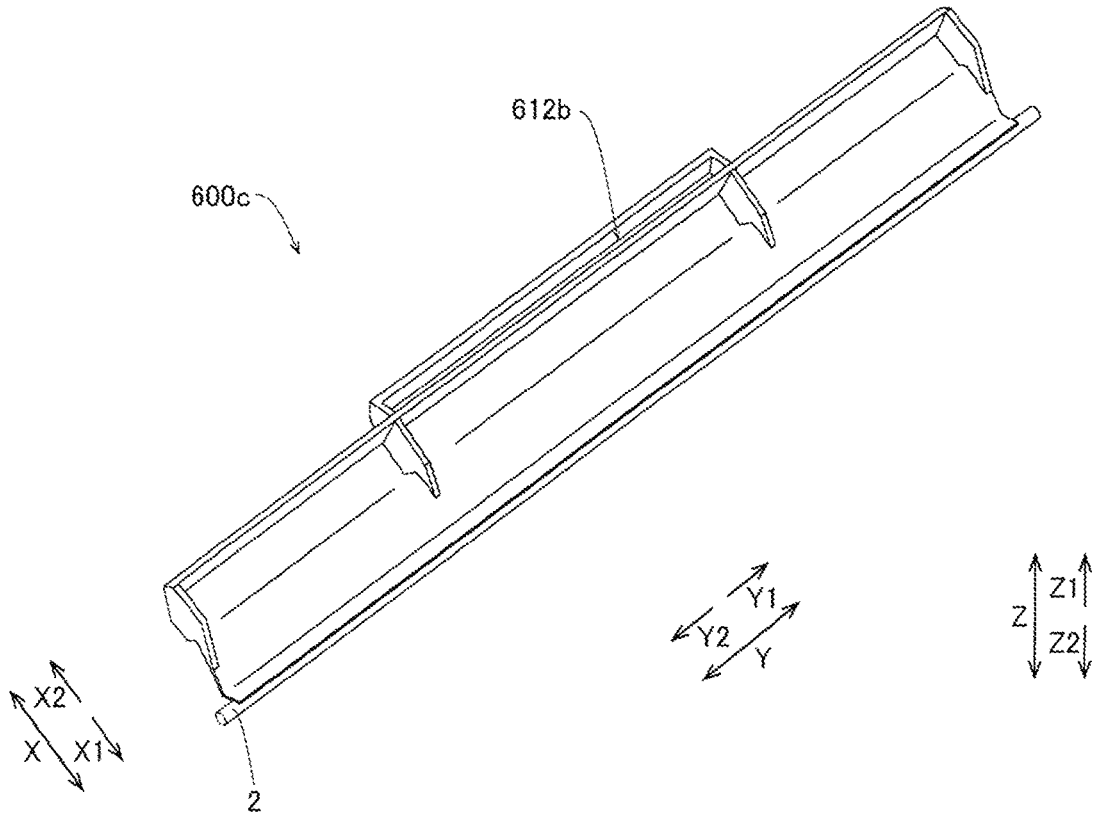
FIG. 13 is a perspective view showing the cover of the image forming apparatus according to the modification of the fifth embodiment of the present invention in the closed state.

An example in which the cutout part is provided in the cover is shown in the fifth embodiment of the present invention, but the present invention is not limited thereto. In one or more embodiments of the present invention, a through hole 612*b* may be provided in the cover 600*c* as a modification example of the fifth embodiment of the present invention shown in FIG. 13. The cover 600*c* is an example of the "invasion suppression part" of the Claims. An example in which the cover 600*c* is not equipped with the roller that contacts the first sheet P1 as shown in the second embodiment of the present invention that is the same as that of the first embodiment of the present invention is illustrated in FIG. 13, but the cover 600*c* may be equipped with the roller that contacts the first sheet P1. In this case, the roller that contacts the first sheet P1 is loaded at the center on the rear side (X2 direction side) of the through hole 612*b*.

Figure 14:
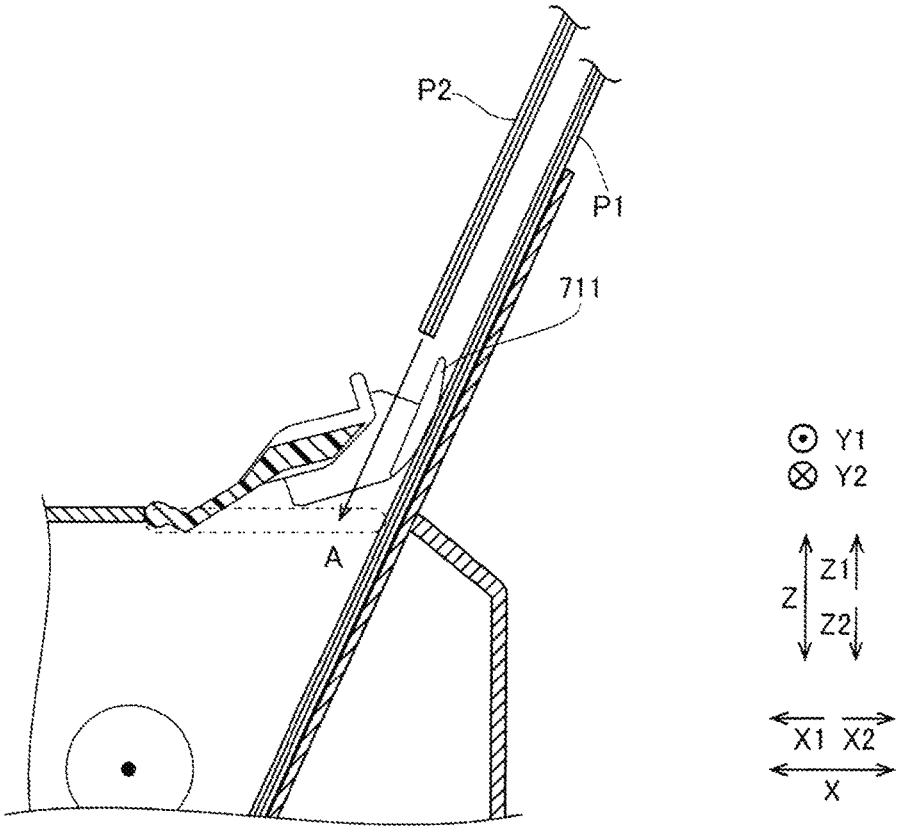
FIG. 14 is a schematic cross-sectional view showing a part of the image forming apparatus according to a modification example of the first embodiment of the present invention.

In addition, examples formed such that the contact part is located at a position lower than the wall when the cover is closed are shown in the first to fifth embodiments of the present invention, but the present invention is not limited thereto. In one or more embodiments of the present invention, it may be formed such that a contact part 711 projects upstream of the sheet feeding direction as a modification of the first embodiment of the present invention shown in FIG. 14.

1. Sheet loading part (second sheet feed tray)
3. Driven roller (contact part)
4. First guide part
5. Second guide part
6. Projection part
7. Auxiliary cover part (lid part)
11, 711. Contact part
12. Sheet insertion part (medium insertion part)
12*a*. Back support part
12*b*, 512*b*. Cutout part
13. Wall
100, 200, 300. Image forming apparatus (sheet feeding apparatus)
100*a*. Sheet feed tray (first sheet feed tray)
100*b*. Casing
100*c*, 200*c*, 300*c*, 400*c*, 500*c*, 600*c*. Cover
101. Sheet feeding port
612*b*. Through hole
P1. First sheet (first medium)
P2. Second sheet (second medium)

What is claimed is:

1. A sheet feeding apparatus comprising:
a casing that comprises a sheet feeding port;
a first sheet feed tray in which a first medium is loaded and that is arranged along the sheet feeding port; and
a cover that rotates around an axis that extends in a width direction orthogonal to a sheet feed direction in which the first sheet feed tray extends,
wherein the axis is disposed opposite and apart from the first sheet feed tray,
wherein the cover comprises a second sheet feed tray that causes a second medium differing in size from the first medium to be capable of being loaded in the sheet feeding port when the cover covers the sheet feeding port,
wherein the second sheet feed tray comprises a contact part that contacts the first medium when the first medium is present in the first sheet feed tray and contacts the first sheet feed tray when the first medium is not present in the first sheet feed tray and the cover covers the sheet feeding port by the rotation,
wherein the second sheet feed tray comprises a medium insertion part into which the second medium is inserted,
wherein the medium insertion part is located on a side of the contact part opposite to a first sheet feed tray side,
wherein a length of the second sheet feed tray in the width direction is shorter than a length of the axis, and
wherein the contact part is located at an end of the second sheet feed tray opposite and apart from the axis.

2. The sheet feeding apparatus according to claim 1, wherein
the cover causes the sheet feeding port to be opened and closed, and
the second sheet feed tray causes the second medium to be loaded when the first medium has been loaded in the first sheet feed tray and the cover is closed.

3. The sheet feeding apparatus according to claim 1,
wherein the second medium is smaller in the width direction than a largest first medium that can be loaded in the first sheet feed tray, and
wherein the width direction orthogonal to the sheet feed direction in which the first sheet feed tray extends.

4. The sheet feeding apparatus according to claim 1, wherein a face of the contact part contacting the first medium or the first sheet feed tray is formed in a convex curved shape toward the first sheet feed tray side in a side view.

5. The sheet feeding apparatus according to claim 1, wherein the contact part comprises an idler roller that is rotated when the first medium is fed.

6. The sheet feeding apparatus according to claim 1,
wherein the cover comprises a wall disposed at an end of the second sheet feed tray on a side opposite to the first sheet feed tray side, and
wherein the wall extends in a direction away from the medium insertion part.

7. The sheet feeding apparatus according to claim 1, wherein the medium insertion part comprises a back support part that extends to a back side of a loaded second medium and supports the second medium from the back side.

8. The sheet feeding apparatus according to claim 1,
wherein the cover comprises a first guide part which is at a right angle to the sheet feed direction, and moves in the width direction in which the first sheet feed tray extends, to adjust the position of the second medium in the width direction, and
wherein the width direction orthogonal to the sheet feed direction in which the first sheet feed tray extends.

9. The sheet feeding apparatus according to claim 1, wherein the contact part extends from a portion that contacts the first medium or the first sheet feed tray to an upstream side in the sheet feed direction.

10. The sheet feeding apparatus according to claim 1, wherein the medium insertion part has a through hole that penetrates the cover or a cutout part cut away from the first sheet feed tray side.

11. The sheet feeding apparatus according to claim 10,
wherein a length of the through hole or the cutout part is slightly longer than a length of the second medium in the width direction, and
wherein the width direction orthogonal to the sheet feed direction in which the first sheet feed tray extends.

12. The sheet feeding apparatus according to claim 1,
wherein the medium insertion part is provided at one side of the first sheet feed tray or at a center of the first sheet feed tray in the width direction, and
wherein the width direction orthogonal to the sheet feed direction in which the first sheet feed tray extends.

13. The sheet feeding apparatus according to claim 2,
wherein the second medium is smaller in the width direction than a largest first medium that can be loaded in the first sheet feed tray, and
wherein the width direction orthogonal to the sheet feed direction in which the first sheet feed tray extends.

14. The sheet feeding apparatus according to claim 4, wherein the contact part comprises an idler roller that is rotated when the first medium is fed.

15. The sheet feeding apparatus according to claim 4, wherein the cover comprises a wall disposed at an end of the second sheet feed tray on a side opposite to the first sheet feed tray side, and wherein the wall extends in a direction away from the medium insertion part.

16. The sheet feeding apparatus according to claim 5, wherein the cover comprises a wall disposed at an end of the second sheet feed tray on a side opposite to the first sheet feed tray side, and wherein the wall extends in a direction away from the medium insertion part.

17. A sheet feeding apparatus comprising:

a casing that comprises a sheet feeding port;

a first sheet feed tray in which a first medium is loaded and that is arranged along the sheet feeding port; and a cover that rotates from a position opposite the first sheet feed tray of the casing to a first sheet feed tray side and covers the sheet feeding port, wherein the cover comprises a second sheet feed tray that causes a second medium differing in size from the first medium to be capable of being loaded in the sheet feeding port when the cover covers the sheet feeding port, wherein the second sheet feed tray comprises a contact part that contacts the first medium or the first sheet feed tray, wherein the second sheet feed tray comprises a medium insertion part into which the second medium is inserted, wherein the medium insertion part is located on a side of the contact part opposite to the first sheet feed tray side, wherein the first sheet feed tray comprises a second guide part that moves in a width direction and adjusts a position of the first medium in the width direction, wherein the cover comprises a projection part that projects to the first sheet feed tray side, wherein the projection part contacts the second guide part when a position of the second guide part overlaps with the second sheet feed tray in the width direction, and wherein the width direction orthogonal to a sheet feed direction in which the first sheet feed tray extends.

* * * * *